US010280515B1

(12) United States Patent
Vitomir

(10) Patent No.: US 10,280,515 B1
(45) Date of Patent: May 7, 2019

(54) WELD MARK TREATMENT

(71) Applicant: Protocol Environmental Solutions Inc., Coquitlam (CA)

(72) Inventor: Sergio Vitomir, New Westminster (CA)

(73) Assignee: Protocol Environmental Solutions, Inc., Coquitlam, BC (CA)

( * ) Notice: Subject to any disclaimer, the term of this patent is extended or adjusted under 35 U.S.C. 154(b) by 573 days.

(21) Appl. No.: 14/580,112

(22) Filed: Dec. 22, 2014

Related U.S. Application Data

(60) Provisional application No. 61/919,460, filed on Dec. 20, 2013.

(51) Int. Cl.
*C23C 22/34* (2006.01)
*C23C 22/50* (2006.01)
*B08B 3/00* (2006.01)

(52) U.S. Cl.
CPC ..... *C23C 22/34* (2013.01)

(58) Field of Classification Search
CPC ..... C23C 22/48; B08B 3/08
USPC ..... 148/240–287
See application file for complete search history.

(56) References Cited

U.S. PATENT DOCUMENTS 6,844,304 B2 1/2005 Lunner et al.
2011/0094630 A1* 4/2011 Yoshida ..... C09D 5/08 148/247

FOREIGN PATENT DOCUMENTS

WO 2013/036999 A1 3/2013

* cited by examiner

*Primary Examiner* — Lois L Zheng
(74) *Attorney, Agent, or Firm* — Umberg Zipser LLP

(57) ABSTRACT

Various compositions and methods are disclosed for treatment of heat tints on stainless steel surfaces that allow for simultaneous pickling and passivation of stainless steel. Moreover, contemplated compositions and methods are free or substantially free of hydrofluoric acid and can be applied in various forms at different temperatures. In further preferred aspects of the inventive subject matter, the compositions contemplated herein include magnesium salts of acids, and especially magnesium salts of hydrofluoric and nitric acid, most typically in an aqueous base. Such compositions are significantly safer for a user and disposal. Where desired, additional ingredients may be added, including surfactants, chelators, thickeners, and/or fillers.

13 Claims, No Drawings

WELD MARK TREATMENT

This application claims the benefit of priority to U.S. Provisional Application having the Ser. No. 61/919,460, which was filed Dec. 20, 2013.

FIELD OF THE INVENTION

The field of the invention is compositions and methods of treatment of metallic surfaces, and especially treatment of weld marks from stainless steel by pickling and passivation.

BACKGROUND OF THE INVENTION

The following description includes information that may be useful in understanding the present invention. It is not an admission that any of the information provided herein is prior art or relevant to the presently claimed invention, or that any publication specifically or implicitly referenced is prior art.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Heat tint is commonly observed in furnace treated stainless steel and in the heat affected zone of weldments, and is the result of the thickening of the naturally occurring transparent oxide layer on the surface of stainless steel. The colors formed are similar to the "temper colors" seen on other steel surfaces following heat treatment and range from pale straw hues to dark blue. As heat tints are formed on the surface of stainless steel, chromium is drawn to the surface due to its preferential susceptibility to oxidation relative to iron in the steel. This leaves a layer at and just below the surface with a lower chromium level than in the bulk of the steel, and so a surface with greatly diminished corrosion resistance. Other oxides present in the heat tint include ferrite that can initiate accelerated corrosion of the weld area.

Heat tint on stainless steel fabrications can be removed using acidic brush-on pastes or gels, spray pickling, or immersion tank pickling. Pickling is a metal surface treatment that removes impurities, such as rust or scale from metals. Most commonly, hydrofluoric acid is the base component that is used for the pickling of stainless steel. Unfortunately, products containing this very harmful and toxic acid require special handling procedures, and its fumes are dangerous to the user and environment.

Passivation is the use of a light coat of a protective material to create a barrier against corrosion. This is typically achieved by nitric acid, which is somewhat easier to handle and by itself is a less dangerous acid. For example, U.S. Pat. No. 6,844,304 to Lunner describes a pickling agent comprising nitric acid, urea, and a filler to remove an oxide layer of stainless steel after heat treatment. Nevertheless, and especially in combination with hydrofluoric acid, such pickling and passivation compositions are still problematic in use and disposal. In other attempts to remove heat tint, as described in U.S. Pat. No. 2,765,271 to Kreml, discoloration is removed by electrolytic treatment of the weld area using phosphoric acid. Similarly, as disclosed in WO 2013/036999 to Lewer, the heat tint is electrochemically removed using low voltage high amperage current with an electrolytic fluid comprising a potassium phosphate salt of an acid at neutral pH. While such compositions are generally benign to the environment and operator, use is complicated by the need for specific equipment and electricity.

In still further known methods, chemically inert solid materials in a carrier fluid are used in a typically high pressure spray gun to remove weld marks from stainless steel as described in EP 2801443. However, such methods will require at least some additional equipment to provide motive force to the cleaning composition.

Therefore, even though various compositions and methods for removing weld marks and increasing corrosion resistance of stainless steel are known in the art, there is still a need to provide improved compositions and methods for treatment of stainless steel.

SUMMARY OF THE INVENTION

The inventors have discovered various compositions and methods for treatment of stainless steel surfaces to treat heat tint that allow for simultaneous pickling and passivation of stainless steel. Moreover, contemplated compositions and methods are free or substantially free of hydrofluoric acid and can be applied in various forms at different temperatures. In further preferred aspects of the inventive subject matter, the compositions contemplated herein include magnesium salts of acids, and especially magnesium salts of hydrofluoric and nitric acid, most typically in an aqueous base. Such compositions are significantly safer for a user and disposal. Where desired, additional ingredients may be added, including surfactants, chelators, thickeners, and/or fillers.

In one aspect of the inventive subject matter, a composition is disclosed that is suitable for treating heat tint by pickling and passivating the stainless steel. The composition comprises a magnesium fluoride salt ($MgF_2$) and a nitrate salt in an aqueous medium having a pH less than 5. The aqueous medium is typically water between 25-50% by weight of the composition and the nitrate salt is typically magnesium nitrate ($Mg(NO_3)_2$). Moreover, the nitrate salt and the magnesium fluoride salt have a ratio of at least 2:1. This excess quantity of nitrate salt helps prevent or reduce dissociation of the magnesium fluoride salt while the composition is used in treating the heat tint by pickling and passivating the stainless steel. It should be appreciated that reducing the dissociation of magnesium fluoride salt is beneficial in preventing the formation of hydrofluoric acid using the fluoride ion of the magnesium fluoride salt. As used herein, dissociation is defined as the process in which ionic compounds (e.g., salts or complexes) separate or split into smaller particles such as ions. The magnesium fluoride salt is between 5-60% by weight of the composition. The nitrate salt is between 15-50% by weight of the composition.

The composition can further include sulfamic acid or oxalic acid. One should appreciate that oxalic acid or sulfamic acid also helps prevent the dissociation of the magnesium fluoride salt, which substantially reduces the formation of hydrofluoric acid. The dissociation of the magnesium fluoride salt is prevented or reduced even when there is a large amount of dilution, such as when the composition is removed from the stainless steel with pressurized water. The sulfamic acid or oxalic acid is between 0.5-50% by weight of the composition.

A surfactant can be included in the composition in an amount between 0.5-15% by weight of the composition.

Suitable surfactants that can be used include at least one of a linear alkyl benzene sulphonic acid and alcohol ethoxylates (C9-11).

It is contemplated that a chelator can be included in the composition. The chelator is between 1.0-15% by weight of the composition. Suitable chelators for the composition include at least one of sodium gluconate, gluconic acid, citric acid, tartaric acid, gluconate salts, and ethylenediaminetetraacetic acid ("EDTA").

A thickening agent can be included in the composition in an amount between 0.1-35% by weight of the composition. Suitable thickening agents are water soluble thickening agents, such as polyethylene oxide. In addition, a filler can be included in an amount between 5.0-50% by weight of the composition. Suitable fillers for the composition include at least one of barium sulphate, clay, silica, fumed silica, glass bubbles, cerium oxide, and earth metals oxides.

In some circumstances it may be necessary to use the composition in cold or below freezing temperatures. For such circumstances, it is contemplated that an antifreeze component is added to the composition, such as propylene glycol. This allows the composition to treat heat tints by pickling and passivation of stainless steel in temperatures below 0° C. and below −20° C. or −50° C.

In another aspect of the inventive subject matter, a method of formulating a composition suitable for treating heat tints by pickling and passivation of stainless steel is contemplated. The method comprises steps of (i) providing a nitrate salt, or forming the nitrate salt using nitric acid and a metal, metal oxide, or metal salt, (ii) providing a magnesium fluoride salt, or forming the magnesium fluoride salt from a magnesium compound using hydrofluoric acid, and (iii) combining the nitrate salt and the magnesium fluoride salt with a carrier to thereby formulate the composition. The hydrofluoric acid is substantially reacted with the magnesium compound to provide the corresponding magnesium fluoride salt.

The method can further include a step of adding at least one of oxalic acid and sulfamic acid. In addition, it is contemplated that the method can include a step of adding at least one of a surfactant, a chelator, a thickening agent, an antifreeze component and a filler. Suitable compositions created by the method can be formulated as a paste, gel, or sprayable compound.

In yet another aspect of the inventive subject matter, a method of treating heat tint by pickling while simultaneously passivating a stainless steel is contemplated. The method includes a step of contacting the stainless steel with a formulation that comprises a magnesium fluoride salt, a nitrate salt, and an acid, such that the nitrate salt and the acid are present in an amount sufficient to substantially reduce formation of hydrofluoric acid caused by dissociation of the magnesium fluoride salt. In addition, the magnesium fluoride salt is present in an amount effective to reduce or remove weld marks via pickling. It should be appreciated that the inclusion of a nitrate salt promotes passivation of the stainless steel. After a contact time between 1-4 hours, the formulation is removed from the stainless steel.

Various objects, features, aspects and advantages of the inventive subject matter will become more apparent from the following detailed description of preferred embodiments.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventor has unexpectedly discovered that compositions comprising water insoluble or extremely low soluble magnesium salts from magnesium nitrate and certain inorganic acids (and especially hydrofluoric acid) are highly effective in the reduction of weld marks by pickling and passivating stainless steel. In addition, the inventor has discovered that such reduction of weld marks (i.e., heat tints) can be provided under conditions that are free or substantially free of hydrofluoric acid.

For example, where a composition is prepared from hydrofluoric acid and magnesium nitrate, it is contemplated that all or substantially all (e.g., at least 95 mol %, more typically at least 98 mol %) of the hydrofluoric acid has reacted with magnesium nitrate to so form a mixture of magnesium nitrate and magnesium fluoride salts where the magnesium fluoride is very little or insoluble in water. Without wishing to be bound by any theory or hypothesis, the inventor contemplates that such mixture can be obtained by combination of magnesium nitrate in molar excess with hydrofluoric acid. Viewed from a different perspective, molar excess of magnesium nitrate will ensure that formation of hydrogen fluoride will not take place or is greatly reduced, therefore rendering the composition to be free or substantially free (e.g., at least 5 mol %, more typically at least 2 mol %, most typically less than 1 mol %) of hydrofluoric acid. In most typical embodiments, a composition that is substantially free of hydrofluoric acid comprises an amount of less than 5 ppm (parts per million) hydrofluoric acid, and more preferably less than 2 ppm hydrofluoric acid.

Consequently, the inventor contemplates a composition suitable for treating heat tint by pickling and passivating stainless steel where that composition comprises an insoluble magnesium salt from an inorganic acid, most typically hydrogen fluoride, and magnesium nitrate. It should be noted that such magnesium salts can be formed in situ at the site of use by combination of appropriate reagents, or be pre-formed and available in a commercially available product.

For example, a composition suitable for treating heat tint by pickling and passivation of stainless steel comprises a magnesium fluoride salt and a nitrate salt in an aqueous medium having a pH less than 5. The nitrate salt and the magnesium fluoride salt are typically in a ratio of at least 2:1 to substantially reduce dissociation of the magnesium fluoride salt, which leads to formation of hydrofluoric acid.

The magnesium fluoride salt is between 5-60% by weight of the composition, and more typically between 8-30% by weight of the composition, and most typically 10-15% by weight of the composition. As briefly discussed above, the magnesium fluoride salt can be produced in situ at the site of use by combination of reagents or obtained in a commercially available product. The recitation of ranges of values herein is merely intended to serve as a shorthand method of referring individually to each separate value falling within the range. Unless otherwise indicated herein, each individual value is incorporated into the specification as if it were individually recited herein.

One manner of producing the magnesium fluoride salt is by reacting hydrofluoric acid with an excess amount of magnesium nitrate. Under such conditions, all or substantially all the hydrofluoric acid reacts with magnesium nitrate to so form a mixture of magnesium nitrate and magnesium fluoride salts where the magnesium fluoride is very little or insoluble in water. Another manner of producing the magnesium fluoride salt is by reacting hydrofluoric acid with a magnesium salt (e.g., magnesium carbonate) in excess amounts or by reacting hydrofluoric acid with a magnesium salt in stoichiometric amounts and adding magnesium nitrate in excess amounts to prevent dissociation of the magnesium fluoride salt. Under such conditions, the hydrofluoric acid reacts with magnesium salt to so form magnesium fluoride salts where the magnesium fluoride salt is very little or insoluble in water. Regardless of the manner of production, it is contemplated that the magnesium fluoride salt is provided in the composition in an amount effective to remove or reduce heat tint of stainless steel via pickling of the stainless steel.

The nitrate salt is between 15-50% by weight of the composition, and more typically between 20-40% by weight, and most typically between 25-30% by weight of the composition. The nitrate salt is preferably a magnesium nitrate. However, other nitrate salts can be used, such as calcium nitrate and beryllium nitrate. The nitrate salt can be produced in situ at the site of use by combination of reagents or obtained in a commercially available product. For example, magnesium nitrate can be produced by reacting nitric acid with a magnesium metal, magnesium oxide, or magnesium salt in stoichiometric amounts. It should be appreciated that the nitrate salt is provided in excess to prevent the magnesium fluoride salt from dissociating, which leads to the formation of hydrofluoric acid using the fluoride ion of the magnesium fluoride. In addition, it is contemplated that the nitrate salt promotes passivation of the stainless steel to reduce the risk of corrosion.

Contemplated compositions can further include sulfamic acid or oxalic acid in an amount between 0.5-50% by weight of the composition, and more typically between 1-15% by weight, and most typically 2-5% by weight of the composition. The sulfamic acid or oxalic acid further ensures that the magnesium fluoride salt does not dissociate. When there is a large amount of dilution, there is a risk that the magnesium fluoride salt can dissociate and the fluoride ion is used to produce hydrofluoric acid. However, using sulfamic acid or oxalic acid acts as a barrier and creates protons to prevent magnesium fluoride salt from dissociating even when there is a large amount of dilution. In addition, the sulfamic acid or oxalic acid acts as a chelating agent to remove iron oxide from stainless steel, such that the iron oxide dissolves so that it can be rinsed off the stainless steel. Therefore, the composition can further be used to remove rust from steel.

Contemplated compositions and formulations may further include additional ingredients to provide one or more desired functionalities, and particularly preferred additional ingredients include surfactants, chelators, thickening agents, fillers, pigments, and odor masking agents. A surfactant can be included in the composition, which will be present between 0.5-15% by weight of the composition, and more typically between 0.5-5% by weight of the composition. Suitable surfactants for the composition include at least one of a linear alkyl benzene sulphonic acid and alcohol ethoxylates (C9-11).

Chelators can be included in the composition between 1.0-15% by weight of the composition, and more typically between 1.0-5% by weight of the composition. Suitable chelators include one or more mono-, bi, and polydentate chelators. For example, contemplated chelators include gluconic acid, citric acid, tartaric acid, gluconate salts, and ethylenediaminetetraacetic acid ("EDTA"). While not limiting to the inventive subject matter, chelating agents are generally preferred in contemplated formulations as chelating agents assist with the removal of pickled oxides of chromium and iron.

Where contemplated formulations are prepared as a gel or paste, thickening agents can be included to adjust the consistency to a desired degree. The thickening agent can be present between 0.1-35% by weight of the composition, and more typically between 0.5-8% by weight of the composition. The thickening agents are preferably water soluble thickening agents, such as polyethylene oxide. Additionally, or alternatively, fillers can be used in the composition. Suitable fillers for the composition include are compounds that are inert, such as barium sulphate, clay, silica, fumed silica, glass bubbles, cerium oxide, earth metals oxides. Fillers can be included in an amount between 5.0-50% by weight of the composition, and more typically between 7-15% by weight of the composition.

While contemplated formulations include a gel or paste, it is contemplated that a spray can also be formulated with the composition. It is contemplated that the amount of fillers and thickening agents will vary from those in the composition of a gel or paste formulation.

It should be appreciated that regardless of the type of formulation, the composition suitable for treating heat tint by pickling and passivation of stainless steel can be applied in cold temperatures. It is contemplated that the composition can include an antifreeze component that does not create auxiliary reactions. Typically, the antifreeze component is propylene glycol. The addition of the antifreeze component allows the composition to be applied in temperatures below 0° C. and even below −20° C. or −50° C. Advantageously, the composition can be applied in gel, paste, or spray formulation throughout the year without incident. The antifreeze component can be included in an amount between 2-30% by weight of the composition, and more typically between 10-20% by weight of the composition. Other suitable antifreeze components include methanol or a glycol (e.g., ethylene glycol).

Where desired, pigments and/or odor masking agents can be included to provide further desired properties.

Still further, it should be appreciated that the composition or formulation will preferably use an aqueous medium, such as an aqueous base or entirely water. However, co-solvents next to water, and even non-aqueous solvents, are also deemed suitable. Regardless of the solvent used, it is generally preferred that the composition or formulation will have a pH between 0.5 to 5, and more typically a pH between 2 to 4. It is contemplated that the aqueous medium is in an amount between 25-50% by weight of the composition.

In another aspect of the inventive subject matter, a method of formulating a composition suitable for treating a heat tint by pickling and passivation of stainless steel is contemplated. The method includes a step of providing a nitrate salt, or forming the nitrate salt using nitric acid and a metal, metal oxide, or metal salt. In preferred embodiments, the nitrate salt is magnesium nitrate, and the magnesium nitrate can be formed by reacting nitric acid with either magnesium metal, magnesium oxide, magnesium carbonate, or some other magnesium salt. All methods described herein can be performed in any suitable order unless otherwise indicated herein or otherwise clearly contradicted by context.

The method further includes a step of providing a magnesium fluoride salt, or forming the magnesium fluoride salt from a magnesium compound using hydrofluoric acid. It is contemplated that all or substantially all the hydrofluoric acid is reacted with the magnesium compound to form the corresponding magnesium fluoride salt. The magnesium compound can be magnesium metal, magnesium oxide or a magnesium salt (e.g., magnesium nitrate or magnesium carbonate). The nitrate salt and the magnesium fluoride salt are combined with a carrier to thereby formulate the composition where the nitrate salt and the magnesium fluoride salt have a ratio of at least 2:1.

The method can further include a step of adding at least one of oxalic acid and sulfamic acid for the various benefits described above (e.g., reducing dissociation of magnesium fluoride salt, chelating iron oxide). In addition, the method can further include a step of adding at least one of a surfactant, a chelator, a thickening agent, an antifreeze component and a filler. Suitable formulations include a paste, gel, dip or sprayable compound.

In further aspect of the inventive subject matter, a method of treating a heat tint by pickling while simultaneously passivating a stainless steel is contemplated. The method includes a step of contacting the stainless steel with a formulation that comprises a magnesium fluoride salt, a nitrate salt, and an acid, such that the nitrate salt and the acid are present in an amount sufficient to prevent formation of hydrofluoric acid caused by dissociation of the magnesium fluoride salt. Contemplated acids that prevent formation of hydrofluoric acid include oxalic acid and sulfamic acid.

When the formulation is applied to a heat tint, the stainless steel is pickled to remove the heat tint while the steel is simultaneously passivated to protect it from corrosion. It should be appreciated that the magnesium fluoride salt is present in an amount effective to reduce or remove weld marks by pickling while the nitrate salt is present in an amount effective to promote passivation of the stainless steel. Therefore, the stainless steel is the heat tint is removed and the stainless steel is protected by passivation using the formulation.

After applying the formulation and allowing time for pickling and passivation of the stainless steel, the formulation is removed from the stainless steel. Contemplated contact times for the formulation onto the stainless steel are between 1-4 hours. The formulation can be removed by using pressurized water. However, since the formulation will be extremely diluted by the addition of pressurized water, there can be a problem with the dissociation of the magnesium fluoride salt. Such dissociation can result in the formation of hydrofluoric acid using the fluoride ion of the dissociated magnesium fluoride salt, which is a toxic residue harmful to the environment. Advantageously, using a nitrate salt and an acid (e.g., oxalic acid or sulfamic acid) as described herein prevented or substantially reduces the formation of hydrofluoric acid by reducing the likelihood that the magnesium fluoride salt will dissociate.

It should be appreciated that the formulation can be applied to rust in metals. Thus, the formulation can be used in areas of the steel that are not affected by a heat tint. Indeed, the formulation described herein comprising oxalic acid or sulfamic acid will act as a chelating agent dissolving the iron oxide so that it could easily be removed.

The following experimental data is disclosed to provide exemplary formulas that achieve pickling and passivation of stainless steel by using non-water soluble salts under conditions that lack of free hydrofluoric acid.

The first formulation has magnesium nitrate as a nitrate salt, magnesium fluoride, and oxalic acid as shown in the following:

| INGREDIENT | % (W/W) |
|---|---|
| 1. Magnesium Nitrate | 27.6 |
| 2. Magnesium Fluoride | 11.6 |
| 3. Barium Sulfate | 9.0 |
| 4. Water | 43.0 |
| 5. Benzene Sulfonic Acid | 0.8 |
| 6. Oxalic Acid | 4.0 |
| 7. Sodium Gluconate | 2.0 |
| 8. Polyethylene Oxide | 2.0 |

pH: 3-4

This composition is effective for treating heat tint by pickling while simultaneously passivating stainless steel. As discussed above, the presence of the magnesium nitrate in excess quantities prevents the magnesium fluoride from dissociating, which prevents formation of hydrofluoric acid. In addition, the oxalic acid also prevents the magnesium fluoride from dissociating and acts as a chelating agent to dissolve iron oxides.

A second formulation has magnesium nitrate as a nitrate salt, magnesium fluoride, and sulfamic acid as shown in the following:

| INGREDIENT | % (W/W) |
|---|---|
| 1. Magnesium Nitrate | 27.6 |
| 2. Magnesium Fluoride | 11.6 |
| 3. Barium Sulfate | 9.0 |
| 4. Water | 43.0 |
| 5. Benzene Sulfonic Acid | 0.8 |
| 6. Sulfamic Acid | 4.0 |
| 7. Sodium Gluconate | 2.0 |
| 8. Polyethylene Oxide | 2.0 |

pH: 3-4

This composition is also effective for treating heat tint by pickling while simultaneously passivating stainless steel. Instead of using oxalic acid, this composition uses sulfamic acid to further prevent the magnesium fluoride from dissociating.

A third formulation is provided with an antifreeze component to allow application of the formulation in freezing temperatures. The formulation has magnesium nitrate as the nitrate salt, magnesium fluoride, oxalic acid, and propylene glycol as the antifreeze component as shown in the following:

| INGREDIENT | % (W/W) |
|---|---|
| 1. Magnesium Nitrate | 27.6 |
| 2. Magnesium Fluoride | 11.6 |
| 3. Barium Sulfate | 9.0 |
| 4. Water | 29.0 |
| 5. Benzene Sulfonic Acid | 0.8 |
| 6. Oxalic Acid | 4.0 |
| 7. Sodium Gluconate | 2.0 |
| 8. Polyethylene Oxide | 2.0 |
| 9. Propylene Glycol | 14.0 |

pH: 3-4

It should be appreciated that using the propylene glycol allows the formulation to be used in temperatures below −20° C. and even below −50° C. This is beneficial since it allows the formulation to be used in freezing temperatures where pickling and passivation. Since an overwhelming number of pickling and passivation is done outdoors due to large sizes of tanks, pickling heat tints and passivation of the stainless steel can be performed during cold winters. It should be appreciated that this formulation is also effective when substituting sulfamic acid for oxalic acid.

A formulation is typically less effective for treating heat tint by pickling and passivation under conditions that lack of free hydrofluoric acid when there is no oxalic acid or sulfamic acid as shown in the following:

| INGREDIENT | % (W/W) |
|---|---|
| 1. Magnesium Nitrate | 27.6 |
| 2. Magnesium Fluoride | 11.6 |
| 3. Barium Sulfate | 9.0 |
| 4. Water | 47.0 |
| 5. Benzene Sulfonic Acid | 0.8 |
| 6. Sodium Gluconate | 2.0 |
| 7. Polyethylene Oxide | 2.0 |

pH: 4-5

Without the presence of oxalic acid or sulfamic acid, there is a risk that the magnesium fluoride can dissociate when there is a large amount of dilution. Consequently, there is a risk that the formulation will produce hydrofluoric acid when the formulation is rinsed from the stainless steel.

The formulation is also less effective when the ratio between the magnesium nitrate and magnesium fluoride is below a preferred level as shown in the following:

| INGREDIENT | % (W/W) |
|---|---|
| 1. Magnesium Nitrate | 22.0 |
| 2. Magnesium Fluoride | 11.6 |
| 3. Barium Sulfate | 9.0 |
| 4. Water | 48.6 |
| 5. Benzene Sulfonic Acid | 0.8 |
| 6. Oxalic Acid | 4.0 |
| 7. Sodium Gluconate | 2.0 |
| 8. Polyethylene Oxide | 2.0 |

pH: 2-4

This formulation has a lower amount of magnesium nitrate with respect to the magnesium fluoride as compared to the previous formulations. The ratio between the magnesium nitrate and magnesium fluoride in this formulation falls slightly below 2:1. Consequently, the formation of some free hydrofluoric acid is produced due to the lack of the magnesium nitrate.

The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of treating a heat tint on stainless steel by pickling and passivation of the stainless steel, comprising:

providing a nitrate salt, or forming the nitrate salt using nitric acid and a metal, metal oxide, or metal salt;

providing a magnesium fluoride salt, or forming the magnesium fluoride salt from a magnesium compound using hydrofluoric acid, such that substantially all the hydrofluoric acid is reacted with the magnesium compound to form the corresponding magnesium fluoride salt;

combining the nitrate salt and the magnesium fluoride salt with a carrier to thereby formulate a composition, wherein the nitrate salt and the magnesium fluoride salt have a ratio of at least 2:1;

wherein the magnesium fluoride salt is present in an amount effective to reduce or remove weld marks, and wherein the nitrate salt is present in an amount effective to promote passivation of the stainless steel; and applying the composition to the stainless steel for a duration of time sufficient for pickling and passivation of the stainless steel.

2. The method of claim 1, further comprising a step of adding at least one of oxalic acid and sulfamic acid.

3. The method of claim 1, further comprising a step of adding at least one of a surfactant, a chelator, a thickening agent, an antifreeze component and a filler.

4. The method of claim 1, wherein the composition is formulated as a paste or sprayable compound.

5. The method of claim 1, wherein the duration is 1-4 hours.

6. The method of claim 1, wherein the composition is formulated to allow for a contact time with the stainless steel between 1-4 hours.

7. The method of claim 1, wherein the magnesium fluoride salt is between 5-60% by weight of the composition.

8. The method of claim 1, further comprising a step of adding sulfamic acid or oxalic acid, wherein the sulfamic acid or oxalic acid is between 3-50% by weight of the composition.

9. The method of claim 1, wherein the nitrate salt is magnesium nitrate and is between 20-50% by weight of the composition.

10. The method of claim 1, further comprising a step of adding a surfactant, wherein the surfactant is between 0.5-15% by weight of the composition.

11. The method of claim 1, further comprising a step of adding a chelator, wherein the chelator is between 1.0-15% by weight of the composition.

12. The method of claim 1, further comprising a step of adding a thickening agent, wherein the thickening agent is between 0.1-35% by weight of the composition.

13. The method of claim 1, further comprising a step of adding a filler, wherein the filler is between 5.0-50% by weight of the composition.

* * * * *